US011872459B2

(12) United States Patent
Dash

(10) Patent No.: US 11,872,459 B2
(45) **Date of Patent: *Jan. 16, 2024**

(54) AQUATIC LEARNING STATION AND METHODS THEREFOR

(71) Applicant: Melon Dash, Sarasota, FL (US)

(72) Inventor: Melon Dash, Sarasota, FL (US)

(73) Assignee: Melon Dash, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/745,545

(22) Filed: May 16, 2022

(65) Prior Publication Data

US 2022/0274000 A1 Sep. 1, 2022

Related U.S. Application Data

(63) Continuation of application No. 17/499,558, filed on Oct. 12, 2021, now Pat. No. 11,331,554.

(60) Provisional application No. 63/131,063, filed on Dec. 28, 2020, provisional application No. 63/131,114, filed on Dec. 28, 2020.

(51) Int. Cl.
*A63B 69/14* (2006.01)

(52) U.S. Cl.
CPC ..... *A63B 69/14* (2013.01); *A63B 2225/09* (2013.01); *A63B 2225/605* (2013.01)

(58) Field of Classification Search
CPC ..... A63B 69/12; A63B 69/14; A63B 2225/09; A63B 2225/605
See application file for complete search history.

(56) References Cited

U.S. PATENT DOCUMENTS

| | | | | |
|---|---|---|---|---|
| 6,251,049 | B1 | 6/2001 | Milton | |
| 7,182,175 | B1 | 2/2007 | Schmitt et al. | |
| 7,377,784 | B2 | 5/2008 | Ryland | |
| 2005/0170936 | A1* | 8/2005 | Quinn | A63B 35/00 482/55 |
| 2008/0085817 | A1 | 4/2008 | Brentlinger et al. | |

* cited by examiner

*Primary Examiner* — Anthony D Wiest
(74) *Attorney, Agent, or Firm* — Bejin Bieneman PLC

(57) ABSTRACT

A system for learning to float including an aquatic learning station deployable in a volume of water. The learning station can include a horizontal member having an upper and a lower surface, wherein the horizontal member is supported in the volume of water with the upper surface located within four inches of a surface of the volume of water. The system can include a tether assembly coupled to the aquatic learning station. The tether assembly can include a tether portion releasably coupled to and extending away from the aquatic learning station and a belt portion connected to the tether portion and wearable by a person learning to float.

13 Claims, 6 Drawing Sheets

AQUATIC LEARNING STATION AND METHODS THEREFOR

CROSS-REFERENCE TO RELATED APPLICATIONS

This application is a continuation of U.S. patent application Ser. No. 17/499,558 filed Oct. 12, 2021, which claims the benefit of and priority to U.S. Provisional Patent Application No. 63/131,063, filed Dec. 28, 2020, and U.S. Provisional Patent Application No. 63/131,114, filed Dec. 28, 2020, the disclosures of which are incorporated herein by reference in their entireties.

TECHNICAL FIELD

This patent application is directed to learning to swim, and more specifically, to methods and teaching aids for learning to float and swim.

BACKGROUND

Many people are afraid to be in water. As a result, some statistics suggest that more than half of Americans do not have the basic skills necessary to safely be in water. Drowning is the 3rd leading cause of unintentional injury death worldwide, accounting for 7% of all injury-related deaths. There are an estimated 320,000 annual drowning deaths worldwide. Nearly 80% of drowning deaths in the United States are by adults.

In addition, to the obvious life-and-death dangers of not having the basic skills to be in water, the fear of being in water can prevent people from enjoying water sports, time at the pool with family and friends, and being near oceans, rivers, lakes, and boats. Accordingly, there is a need to help people become comfortable in the water and learn the basic skills of floating and therefore autonomy and control to safely be in, and around water.

SUMMARY

In some embodiments, a system for learning to float can include an aquatic learning station deployable in a volume of water. The learning station can include a horizontal member having an upper and a lower surface, wherein the horizontal member is supported in the volume of water with the upper surface located within four inches of a surface of the volume of water. The system can also include a tether assembly coupled to the aquatic learning station. The tether assembly can include a tether portion releasably coupled to and extending away from the aquatic learning station and a belt portion connected to the tether portion and wearable by a person learning to float.

In some aspects, the aquatic learning station further comprises two upright members, each coupled to the horizontal member at a first end and a corresponding footing connected to each upright member at a second end. In other aspects, the two upright members are each coupled to the horizontal member with a corresponding T-fitting, and wherein one leg of each T-fitting is open to facilitate filling the upright members and footings with water. According to some aspects, the two upright members have an adjustable length. In some aspects, the aquatic learning station further comprises a hook portion coupled to each end of the horizontal member, wherein the hook portions are configured to engage a side of a swimming pool. In further aspects, the upper surface of the horizontal member is above the surface of the volume of water. According to some aspects, the tether portion includes a first portion couplable to the horizontal member and an elongate second portion connected to the first portion at a proximate end and connected to the belt portion at a distal end. In some aspects, the elongate second portion has an adjustable length. In other aspects, the first portion, the second portion, and the belt portion comprise strap.

In some embodiments, a tether assembly for learning to float can include a tether portion releasably couplable to a support member located in, on, or, adjacent to a volume of water and a belt portion connected to the tether portion and wearable by a person learning to float.

In some aspects, the tether portion includes a first portion couplable to the support member and an elongate second portion connected to the first portion at a proximate end and connected to the belt portion at a distal end. According to some aspects, the elongate second portion has an adjustable length. In other aspects, the first portion, the second portion, and the belt portion comprise strap. In some further aspects, the first portion, the second portion, and the belt portion are connected with plastic side release buckles.

In some embodiments, a method for learning to float can include positioning a support member near a surface of a body of water and coupling a tether assembly to the support member. The method can also include attaching a belt portion of the tether assembly to a person learning to float and positioning the person learning to float in the water near the support member.

According to some aspects, the support member is a horizontally oriented member positioned within four inches of the surface. In some aspects, the method further comprises positioning the person learning to float in the water under the horizontal member in a supine position. In some aspects, positioning the horizontal member includes supporting the upper surface of the horizontal member above the surface of the volume of water. In other aspects, the method can further comprise subsequently increasing the length of the tether assembly. In further aspects, supporting the horizontal member includes supporting the horizontal member with a pair of upright members and further comprises filling the pair of upright members with water.

BRIEF DESCRIPTION OF THE DRAWINGS

The aquatic learning station, systems, and methods described herein may be better understood by referring to the following Detailed Description in conjunction with the accompanying drawings, in which like reference numerals indicate identical or functionally similar elements.

Figure 1:
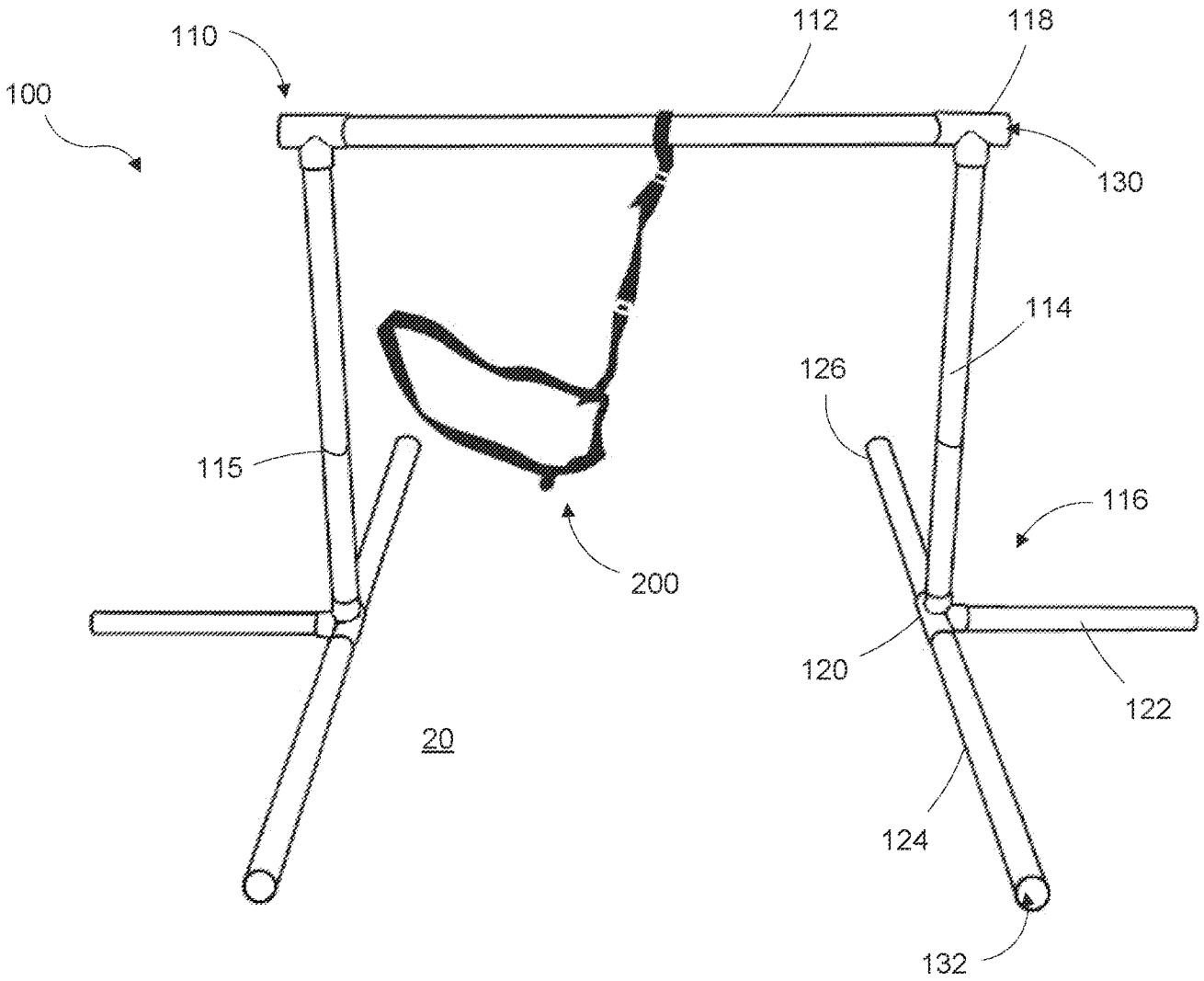
FIG. 1 is a perspective view of an aquatic learning station and tether assembly according to some embodiments of the disclosed technology.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all suitable modifications, combinations, equivalents, and alternatives falling within the scope of this disclosure.

DETAILED DESCRIPTION

Various examples of the devices introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

Disclosed herein are systems and methods for helping people learn to be comfortable in water and learn to float and/or swim. The disclosed technology allows a person learning to float, for example, to connect themselves using a tether to an aquatic learning station (also referred to herein as a float bar), pool ladder, or rail. This allows the person to feel safe, knowing they will not drift away. The person is securely connected by the tether so that they can float as close to the aquatic learning station, pool ladder, or rail as they want.

FIG. 1 illustrates a system 100 for learning to float, including an aquatic learning station 110 and tether assembly 200 according to some embodiments of the disclosed technology. The aquatic learning station 110 is deployable in a volume of water 20, such as a swimming pool. In some embodiments, the learning station 110 can include a horizontal member 112 supported in the volume of water 20 by two upright members 114 (i.e., right and left), each coupled to the horizontal member 112 with a "T-shaped" fitting, such as T-fitting 118, for example. It should be understood that, as used herein, the term "horizontal" does not require the member to be absolutely horizontal with respect to the surface of the water. Instead, the horizontal member can be angled with respect to the surface within a reasonable allowance that does not hinder the operation and/or construction of the aquatic learning station. In some embodiments, the horizontal member can be angled approximately 10-15 degrees with respect to the surface.

Each upright member 114 can be coupled to the horizontal member 112 at a first end portion and coupled to a corresponding footing 116 at a second end portion. The footings 116 can each include a four-way T-fitting 120 with lateral 122, fore 124, and aft 126 foot portions extending therefrom. As left and right upright members 114 and corresponding foot portions 116 are identical, it is sufficient to describe one side herein. In some embodiments, the two upright members 114 can have an adjustable length (e.g., telescoping tube portions 115). In some embodiments, telescoping upright members can comprise two different diameter tubing portions (e.g., 1-½ and 2 inch) coupled together with a suitable slip fitting, for example.

In some embodiments, one leg of each T-fitting 118 is open (e.g., opening 130) to facilitate filling the upright members 114 and horizontal member 112 with water. Accordingly, in some embodiments, T-fittings 118 are three-way T-fittings. Similarly, one end of the foot portions 122, 124, and 126 can be open (e.g., opening 132) to allow water to fill the footings 116 and upright members 114. In some embodiments, the learning station 110 can comprise 1-½ inch, schedule 40 PVC pipe and T-fittings. The pipe can be pushed and/or glued together, for example.

Figure 2:
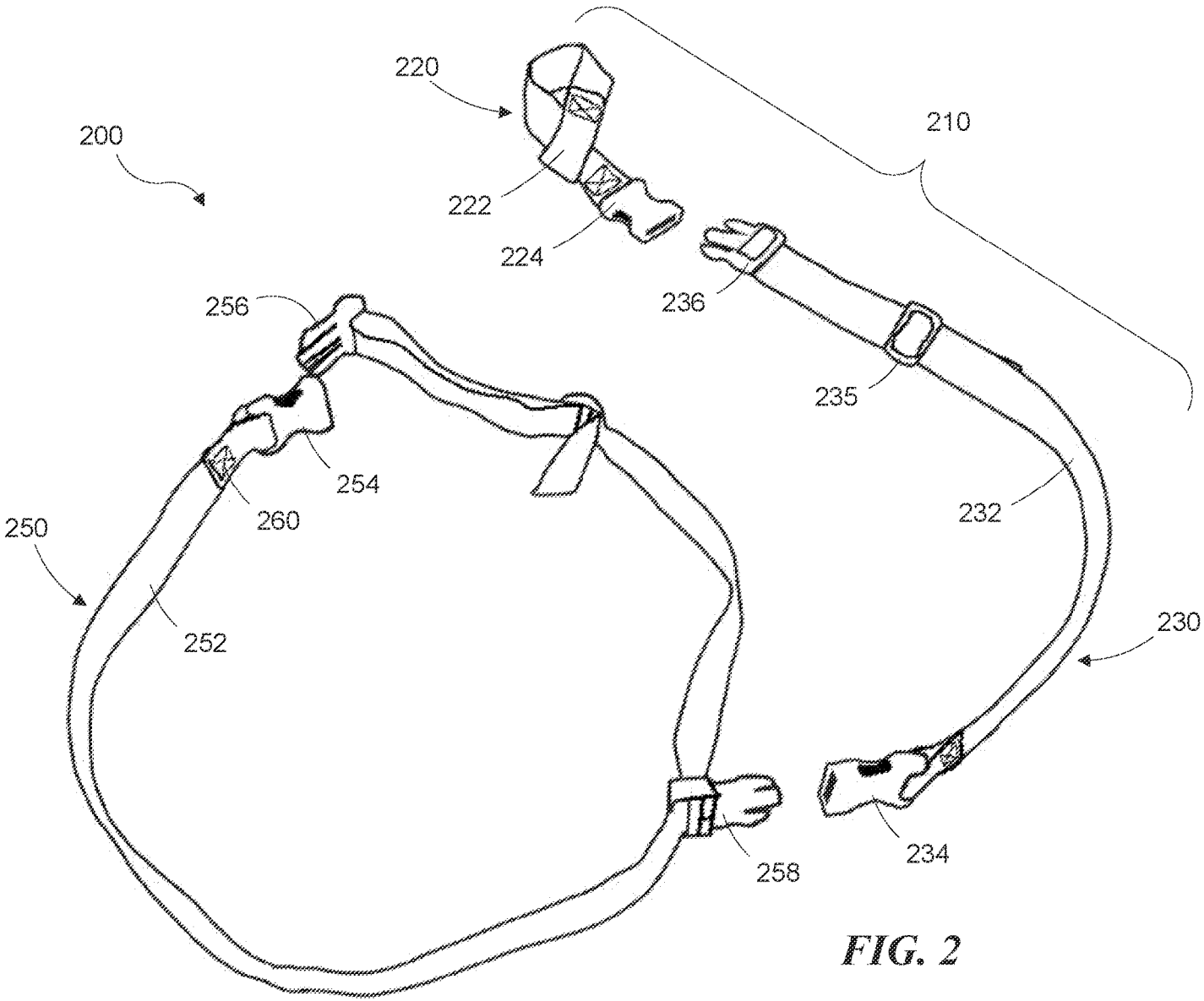
FIG. 2 is a perspective view of the tether assembly shown in FIG. 1.

With reference to FIG. 2, the tether assembly 200 can include a tether portion 210 and a belt portion 250 connected to the tether portion 210 and wearable by a person learning to float. The tether portion 210 can include a first portion 220 (also referred to herein as an anchor) couplable to the horizontal member 112 and an elongate second portion 230 connected to the first portion 220 at a proximate end (i.e., male connector 236) and connected to the belt portion 250 at a distal end (i.e., female connector 234).

The first portion 220 can include a loop portion 222 whereby the female connector 224 can be extended around the horizontal member 112 and threaded through the loop 222 to securely couple the first portion 220 to the horizontal member 112. The elongate second portion 230 can be connected to the female connector 224 of the first portion 220 with a mating male connector 236. The elongate second portion 230 can be connected to a male connector 258 of the belt portion 250 with the mating female connector 234. The second portion 230 can comprise nylon strap 232 having a slide 235 to facilitate adjusting the length.

The belt portion 250 can include a nylon strap 252 with cooperative connectors 254 and 256 disposed at each end with the male connector 258 positioned between them. In general, the connectors can be secured to the corresponding nylon straps with suitable stitching 260, for example. In some embodiments, the connectors can be cooperative male and female plastic side release buckles. While the embodiments described herein describe the male and female connectors in specific arrangements, it should be understood that the connectors can be reversed from that shown and described. Furthermore, although particular styles of nylon strap and mating/cooperative connectors are depicted, other suitable materials and types of connectors can be used. In addition, some portions of the tether assembly can be combined, omitted, and/or added. For example, in some embodiments, the belt portion 250 and second portion 230 can be combined into one strap. In some implementations, the belt portion 250 can be connected directly to the first portion 220, for example.

Figure 3A:
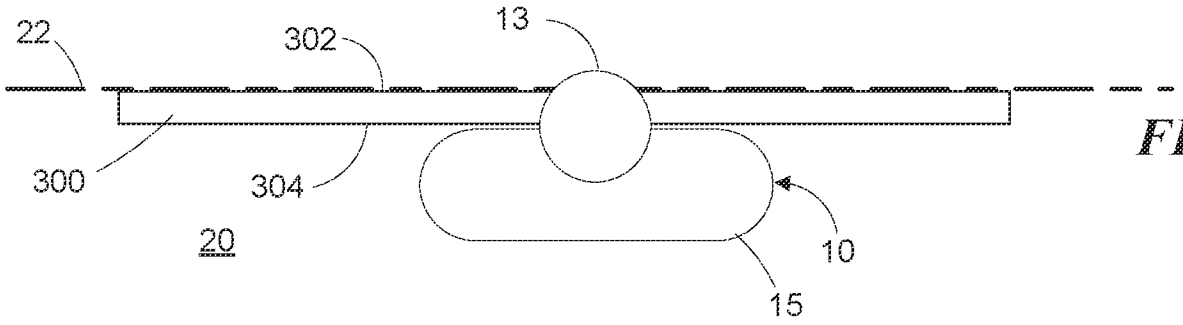
FIG. 3A is a schematic diagram illustrating the positioning of the horizontal member with respect to the surface of the water in a first configuration.
Figure 3B:
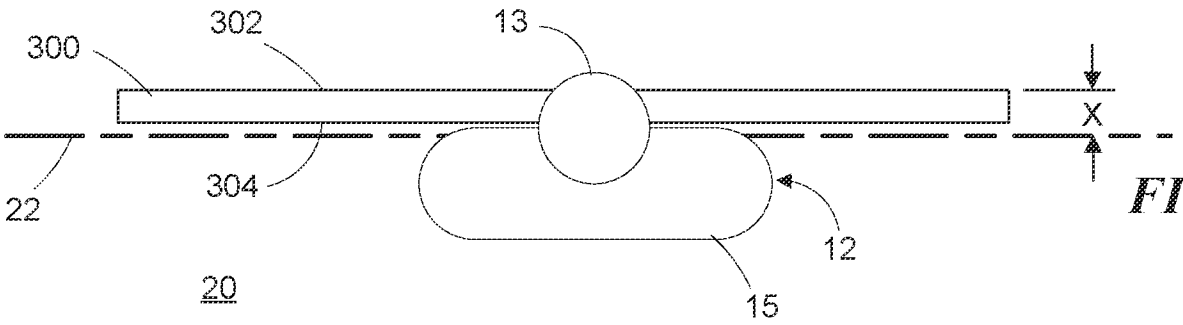
FIG. 3B is a schematic diagram illustrating the positioning of the horizontal member with respect to the surface of the water in a second configuration.

FIGS. 3A and 3B illustrate how an aquatic learning station can be used in some embodiments of the disclosed technology. The horizontal member 300 has an upper surface 302 and a lower surface 304. In FIG. 3A, the horizontal member 300 is supported in the water such that the upper surface 302 is just touching the surface (indicated by dashed line 22) of the volume of water 20. The person learning to float 10 is positioned in the water under the horizontal member 300 with their head 13 and shoulders 15 at least partially in the water. In some embodiments, the person learning to float 10 can be positioned in a supine (i.e., face up) position. In some embodiments, the person learning to float 10 can be positioned in a prone (i.e., face down) position.

In FIG. 3B, the horizontal member 300 is supported such that the upper surface 302 is above the surface 22 of the volume of water 20. In some embodiments, the upper surface 302 is within a distance X above (or below) the surface 22. In some embodiments, X can be between +4 inches and −8 inches. In some embodiments, the upper surface 302 can be within 2 inches above or below the surface 22. The position of the upper surface 302 can be adjusted to account for the buoyancy of the person learning to float. For example, FIG. 3B illustrates the horizontal member 300 positioned for a person 12 that is more buoyant relative to the person 10 shown in FIG. 3A. The position of the horizontal member can be adjusted by changing the length of the upright supports, telescoping the upright members, and/or moving the learning station to deeper or shallower water.

Figure 4:
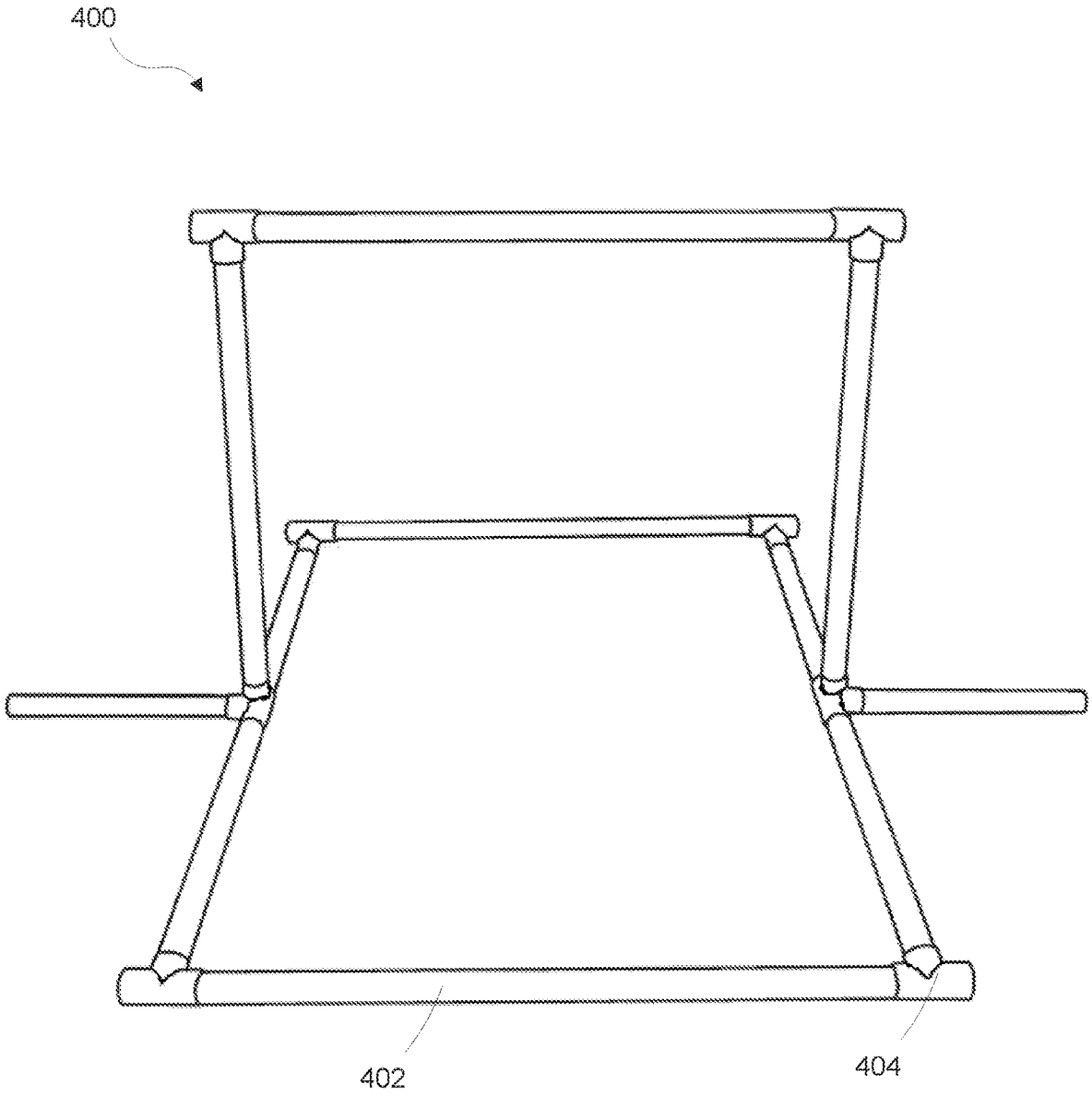
FIG. 4 is a perspective view of an aquatic learning station according to some embodiments of the disclosed technology.

FIG. 4 illustrates an aquatic learning station 400 according to some embodiments of the disclosed technology. Learning station 400 is similar to learning station 100 described above with respect to FIG. 1 with the addition of cross members 402 extending between the footings and associated T-fittings 404. The T-fittings 404 can be three-way fittings to connect the footings and cross members while allowing an opening for water to fill the learning station 400.

Figure 5:
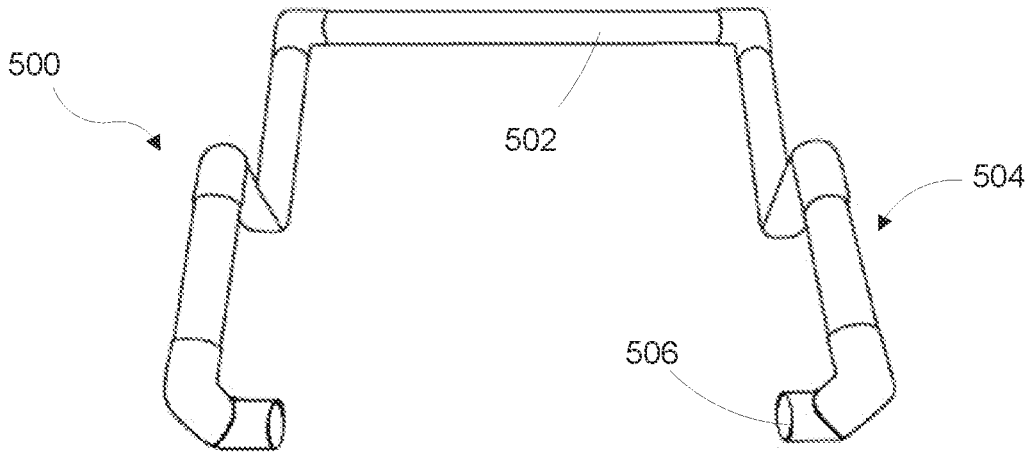
FIG. 5 is a top perspective view of an aquatic learning station configured to engage the side of a pool according to some embodiments of the disclosed technology.
Figure 6:
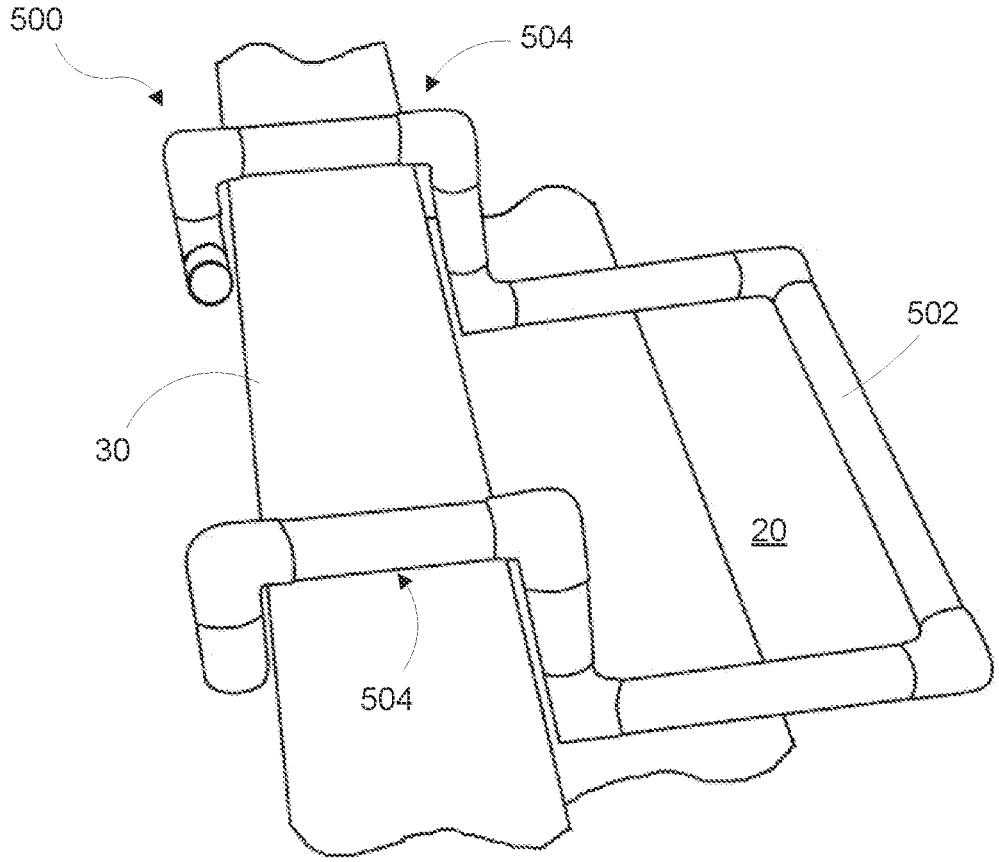
FIG. 6 is a side perspective view of the aquatic learning station shown in FIG. 5.

FIGS. 5 and 6 illustrate an aquatic learning station 500 configured to engage the side 30 of a pool according to some embodiments of the disclosed technology. The learning station 500 can include a horizontal member 502 extending between two hook portions 504. The hook portions 504 can be configured to follow the contours of the side 30 of a pool, thereby engaging the side of the pool to support the horizontal member 502 in or near the water 20. In some embodiments, each hook portion 504 includes a foot 506. In some embodiments, a cross member (not shown) can extend between the feet 506 to further stabilize the learning station 500. In some embodiments, the foot portions 506 can be custom-fitted to the pool. In other embodiments, one or more portions of the learning station 500 can be replaceable and/or extendable/collapsible (e.g., telescoping tube portions) in order to fit different size pool constructions.

Figure 7:
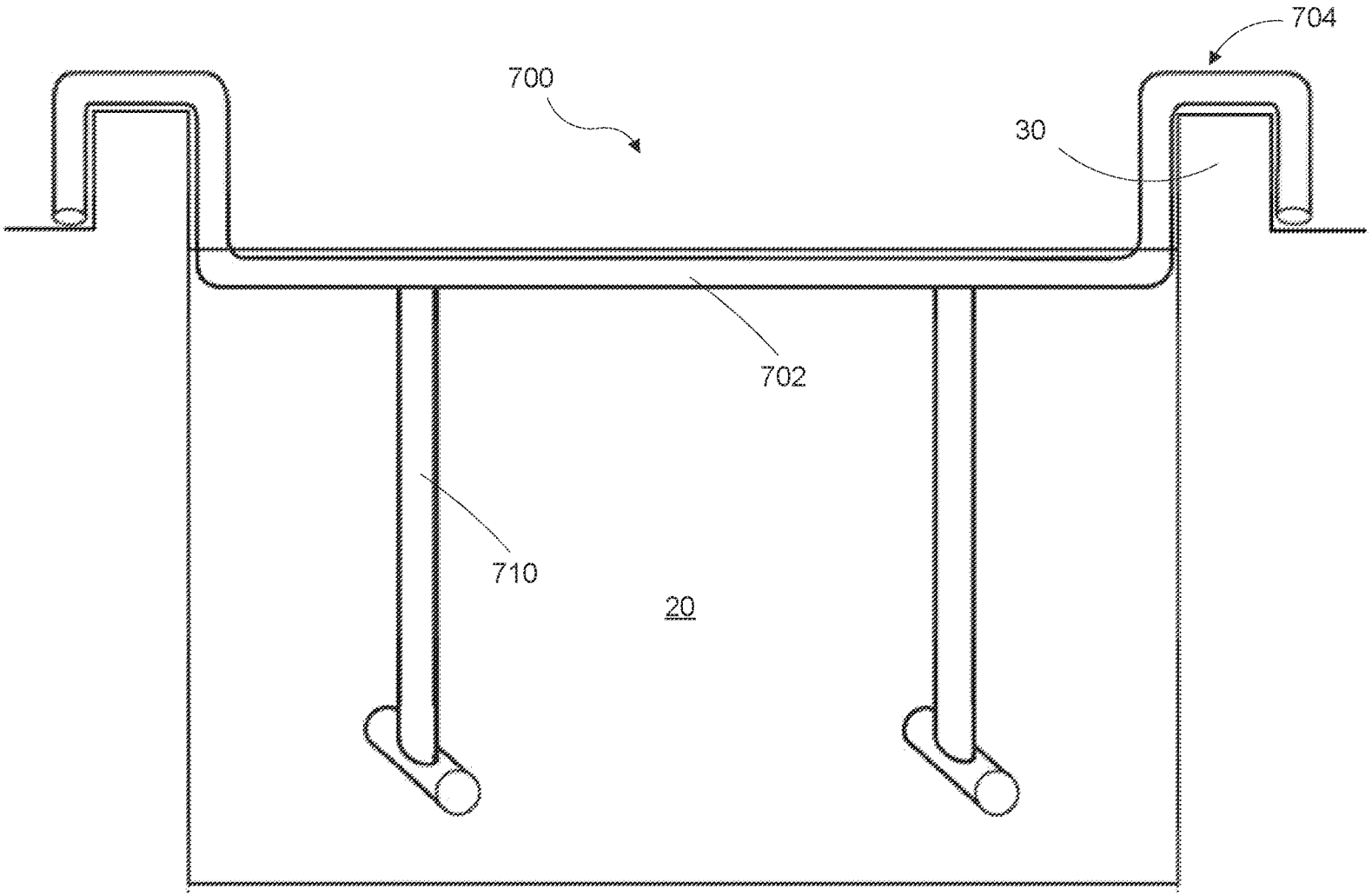
FIG. 7 is a perspective view of an aquatic learning station configured to span the width of a pool and engage both sides of the pool according to some embodiments of the disclosed technology.

FIG. 7 illustrates an aquatic learning station 700 configured to span the width of a pool and engage both sides 30 of the pool according to some embodiments of the disclosed technology. The learning station 700 can include a horizontal member 702 with a hook portion 704 disposed at each end. The horizontal member 702 is sized to extend across the width of the pool. In some embodiments, the horizontal member 702 can be supported in the middle with one or more upright members 710.

Disclosed herein are methods for learning and/or teaching a person to float. In some embodiments, a method for learning to float can include positioning a support member adjacent a volume of water. In some embodiments, the support member can be a horizontal member supported within e.g., two to four inches of a surface of a body of water. The method can also include coupling a tether assembly to the support member and attaching a belt portion of the tether assembly to a person learning to float. The method can further include positioning the person learning to float in the water under the horizontal member. In some embodiments, the person learning to float can be positioned in a supine position under the horizontal member or a prone position in back of the horizontal member. In some embodiments, the method can include subsequently increasing the length of the tether assembly. In some embodiments, supporting the horizontal member includes supporting the horizontal member with a pair of upright members and filling the pair of upright members with water.

Disclosed herein are kits for learning to float. In some embodiments, a kit for learning to float can include an aquatic learning station as disclosed herein. In some embodiments, the kit can contain an assembled station or parts with instructions for assembling the station. The kit can further include a tether assembly along with instructions for using the tether assembly and learning station in a pool or other body of water. The instructions can include steps for setting up the station and tether as well as how to position a person learning to float including some or all of the method steps and description of the aquatic learning stations and tethers disclosed herein. In some embodiments, a kit can include aquatic learning station plans to build a float bar with PVC pipe; instructions with photos; instructions for how to use the float bar; a tether assembly (including the three straps and instructions); a how-to book; a how-to DVD; and/or access to an instructional podcast.

In some embodiments, the instructions can include steps directing a user to attach the anchor portion to the float bar; put the belt around their waist; connect the belt to the anchor portion; stand in the pool near the float bar; hold on to float bar and lie back in the water. The instructions can also direct a user to lie in that configuration until they are comfortable and feel the water holding them up such that they want to release the float bar. Once they have done this off and on over the course of several hours they can use the elongate strap portion (i.e., second portion) connected between the belt and the anchor portion. The instructions can also direct a user to stand in the pool near the float bar; connect themselves to the float bar as explained above, and place their face in the water while holding onto the float bar which enables a desire to drop their hands from the bar. This is about learning how to float and/or how the water and a person's body work together without the use of a life vest, personal flotation device (PFD), or other flotation device.

REMARKS

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A system for learning to float, comprising:

an aquatic learning station deployable in a volume of water, the learning station including:

a horizontal member having an upper and a lower surface, wherein the horizontal member is supported in the volume of water with the upper surface located proximate a surface of the volume of water;

two upright members, each coupled to the horizontal member at a first end; and a corresponding footing connected to each upright member at a second end, wherein the two upright members include an opening to facilitate filling the upright members and footings with water; and a tether assembly coupled to the aquatic learning station, the tether assembly including:

a tether portion releasably coupled to and extending away from the aquatic learning station; and a belt portion connected to the tether portion and wearable by a person learning to float.

2. The system of claim 1, wherein the two upright members have an adjustable length.

3. The system of claim 1, wherein the aquatic learning station further comprises a hook portion coupled to each end of the horizontal member, wherein the hook portions are configured to engage a side of a pool.

4. The system of claim 1, wherein the upper surface of the horizontal member is above the surface of the volume of water.

5. The system of claim 1, wherein the tether portion includes a first portion couplable to the horizontal member and an elongate second portion connected to the first portion at a proximate end and connected to the belt portion at a distal end.

6. The system of claim 5, wherein the elongate second portion has an adjustable length.

7. The system of claim 5, wherein the first portion, the second portion, and the belt portion comprise strap.

8. A tether assembly for learning to float, comprising:

a support member including a horizontal member supported by a pair of upright members;

a belt portion wearable by a person learning to float; and a tether portion releasably couplable to the support member, wherein the tether portion includes:

a first portion having a loop portion and an opposite end portion, wherein the opposite end portion can be extended around the support member and threaded through the loop portion to couple the first portion to the support member; and an elongate second portion connected to the first portion at a proximate end and connected to the belt portion at a distal end, wherein the elongate second portion has an adjustable length;

wherein the first portion, the second portion, and the belt portion comprise strap, and wherein the first portion, the second portion, and the belt portion are connected with side release buckles.

9. A method for learning to float, comprising:

positioning a support member near a surface of a body of water;

at least partially filling the support member with water;

coupling a tether assembly to the support member, wherein the tether assembly includes:

a first portion having a loop portion and an opposite end portion;

an elongate second portion having a proximate end and a distal end; and a belt portion;

wherein coupling the tether assembly to the support member includes extending the opposite end portion around the support member and threading the opposite end portion through the loop portion to couple the first portion to the support member;

connecting the proximate end of the second portion to the opposite end portion of the first portion;

attaching the belt portion of the tether assembly to a person learning to float;

connecting the belt portion to the distal end of the elongate second portion;

positioning the person learning to float in the water near the support member in a supine position; and subsequently increasing the length of the tether assembly.

10. The method of claim 9, wherein the support member is a horizontally oriented member.

11. The method of claim 10, further comprising positioning the person learning to float in the water under the horizontal member.

12. The method of claim 10, wherein positioning the horizontal member includes supporting the upper surface of the horizontal member above the surface of the volume of water.

13. The method of claim 10, wherein supporting the horizontal member includes supporting the horizontal member with a pair of upright members and further comprising filling the pair of upright members with water.

* * * * *